US005180883A

United States Patent [19]

Jaskolka et al.

[11] Patent Number: 5,180,883

[45] Date of Patent: Jan. 19, 1993

[54] AMMUNITION

[75] Inventors: Heinz Jaskolka, Velbert; Eckhard Rahnenführer, Dormagen; Albert Schulze, Mönchengladbach, all of Fed. Rep. of Germany

[73] Assignee: Rheinmetall GmbH, Düsseldorf, Fed. Rep. of Germany

[21] Appl. No.: 809,128

[22] Filed: Dec. 18, 1991

[30] Foreign Application Priority Data

Dec. 22, 1990 [DE] Fed. Rep. of Germany ..... 4041611

[51] Int. Cl.[5] ..... F42B 5/02; F42B 5/36

[52] U.S. Cl. ..... 102/443; 102/439; 102/523

[58] Field of Search ..... 102/443, 439, 430, 432, 102/464, 434, 520, 521, 522, 523

[56] References Cited

U.S. PATENT DOCUMENTS

| | | | |
|---|---|---|---|
| 390,232 | 10/1888 | Hurst | 102/443 |
| 2,410,435 | 11/1946 | Evans | 102/439 |
| 3,981,246 | 9/1976 | Luther et al. | 102/521 |
| 4,197,801 | 4/1980 | LaFerer et al. | 102/443 |
| 4,702,167 | 10/1987 | Reinelt et al. | 102/282 |
| 4,763,577 | 8/1988 | Romer et al. | 102/523 |
| 4,864,932 | 9/1989 | Reinelt et al. | 102/282 |

FOREIGN PATENT DOCUMENTS

| | | |
|---|---|---|
| 0429753A1 | 7/1990 | European Pat. Off. . |
| 3442741A1 | 5/1986 | Fed. Rep. of Germany . |
| 2039008A | 7/1980 | United Kingdom . |
| 2239694A | 7/1991 | United Kingdom . |

*Primary Examiner*—David H. Brown

*Attorney, Agent, or Firm*—Spencer, Frank & Schneider

[57] ABSTRACT

To improve the combustion behavior of a two-part large-caliber ammunition round (10) composed of a primary charge (20) and a projectile charge (30), an annular transfer charge (29) is provided in the primary charge (20) underneath a charge casing cover (28) which terminated the primary charge toward the top. The projectile charge (30) is also provided with an annular transfer charge (39) above its propelling charge casing bottom (38). The transfer charge (29) disposed in the primary charge (20) results in rapid destruction of the charge casing cover (28) and of the casing bottom (38). The annular transfer charge (39) disposed in the projectile charge (30) improves the ignition of the tubular propellant (32) disposed in the projectile charge (30) and of the loose powder charge (36) without noticeable time delays relative to the primary charge (20).

14 Claims, 1 Drawing Sheet

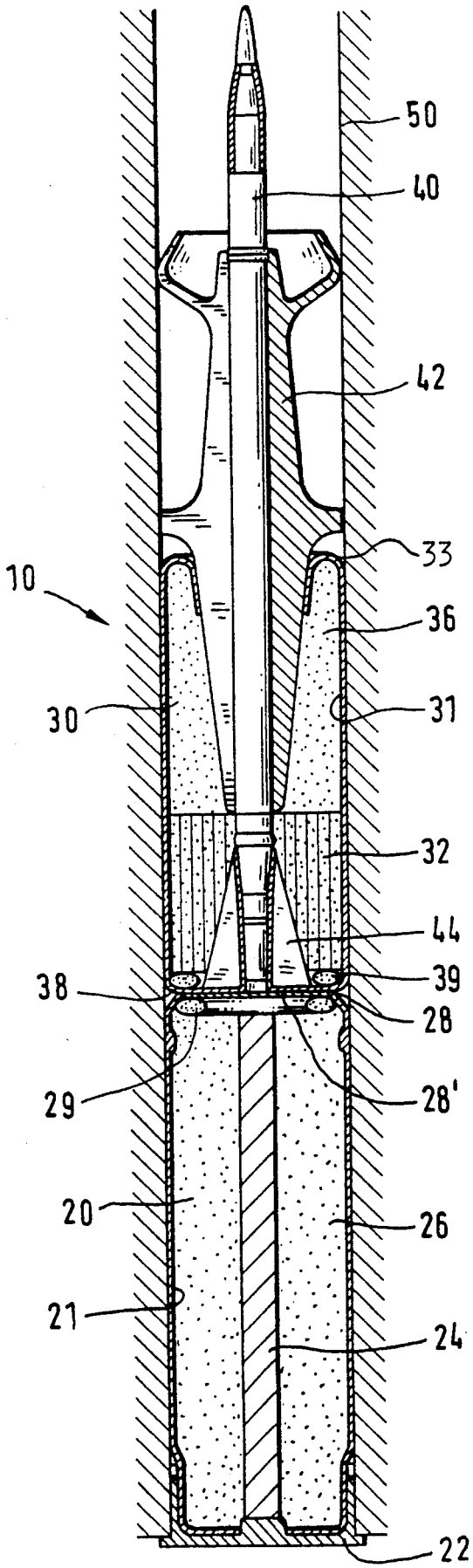
50
40
42
33
10
36
30
31
32
44
38
39
28
29
28'
20
26
21
24
22

AMMUNITION

BACKGROUND OF THE INVENTION

The present invention relates to ammunition of the type including two separate charges; in particular a forward projectile charge including a projectile whose rear end extends far into the projectile charge and a rear primary charge.

An ammunition round of the above type, composed of two separate ammunition components, is disclosed in commonly owned published European Patent Application No. 0,429,753 published Jun. 5, 1991, corresponding to U.S. patent application Ser. No. 07/618,565, filed Nov. 27, 1990, now U.S. Pat. No. 5,133,240.

In modern, large-caliber ammunition, the drive systems become so long and heavy that they are divided into a forward ammunition component into whose nose the projectile is inserted, and a rear ammunition component in order to make it easier for the soldier to handle the ammunition at the weapon.

Ammunition constructed of separate parts, i.e. a projectile and a propelling charge, is already known for large-caliber artillery ammunition. In such ammunition, the propelling charges are transported in a propelling charge container and, once the projectile has been loaded, are removed from the transporting container and conveyed to the charge chamber of the weapon behind the projectile. The propelling charges are composed cf individual partial charges which are disposed, for example, in interconnected propelling charge bags. The component of such an ammunition round on the side of the projectile has no separate propelling charge casing so that, in such an arrangement, the problem of ignition transfer from the propelling charge to another portion of the ammunition does not occur.

In modern artillery ammunition, propelling charge modules in cylindrical containers made of a combustible material are also employed instead of the interconnected propelling charge bags. European Patent No. 0,227,671.B1 and corresponding U.S. Pat. Nos. 4,702,167 and 4,864,932 disclose such a propelling charge module—wherein the individual modules have a free coaxial ignition channel. The free ignition channel is disposed within an ignition charge in the propelling charge module so that the ignition of the individual modules occurs centrally throughout. The problem of additional circumferential ignition therefore does not exist in such propelling charge modules.

Federal Republic of Germany published patent application No. DE-3,442,741.A1, published May 27, 1986, relates to a charge arrangement for cartridged ammunition including a propelling charge casing and a projectile inserted therein. A propelling charge igniter surrounded by a booster charge ring is fastened at the bottom of the casing. Moreover, a propelling charge is provided which is composed of loose powder and is coaxially surrounded by a transfer charge composed of a tubular propellant which lies directly against the interior wall of the propelling charge casing.

This charge configuration serves to provide for easy installation of projectiles that extend far into the propelling charge casing. The annular booster charge is ignited by an igniter charge and then ignites the loose powder disposed in front of the booster charge and the tubular propellant lying against the wall of the propelling charge casing. The entire loose powder charge is thus ignited by the tubular propellant radially from the outside over a large area. The problem of igniting separate propelling charges through the propelling charge casing material therefore does not occur in such a charge arrangement.

SUMMARY OF THE INVENTION

It is an object of the present invention to improve a two-part ammunition round of the above originally mentioned type so that both charges are ignited uniformly and the combustion behavior is improved.

The above object is generally achieved by an ammunition round which comprises: a projectile; two separate charges to be aligned one behind the other including, a forward projectile charge, with a rear end of the projectile extending far into the forward charge, and a rear primary charge; and first and second annular transfer charges disposed respectively adjacent a front end of the primary charge and a rear end of the projectile charge in the region of a respective outer circumference of the projectile charge and of the primary charge.

According to the preferred embodiment the forward projectile charge includes a charge casing containing a propellant and including a generally cylindrical member which is closed at its rear end by a bottom member and which has a cover with a central opening, through which the projectile extends into the charge casing, at its front end, the rear primary charge includes a charge casing containing a propellant and including a generally cylindrical member which is closed at its rear end by a bottom member and its front end by a cover, the charge casing of the forward projectile charge and at least the cylindrical member and the cover of the charge casing of the rear primary charge are formed of a combustible material, the first annular transfer charge is disposed within the charge casing of the primary charge adjacent its cover, and the second annular transfer charge is disposed within the charge casing of the projectile charge adjacent the bottom member.

According to a preferred feature of the invention, the propelling charge in the charge casing of the projectile charge is composed at least in part of a tubular propellant, with the tubular propellant being disposed at least in the rear portion of the charge casing of the projectile charge and immediately adjacent the second annular transfer charge. This propelling charge may be composed entirely of the tubular propellant or may include loosely piled propelling charge powder disposed in front of the tubular propellant.

According to further preferred features of the invention the annular transfer charge in the forward projectile charge is composed of black powder (rich in hot particles after ignition), and the annular transfer charge in the rear primary charge is composed of an ignition powder or propellant (rich in gas after ignition), e.g. nitrocellulose black powder.

As indicated above in modern large-caliber ammunition, the drive systems become so long and heavy that, for better manipulation, they must be divided into a primary charge and a projectile charge. With such an ammunition structure, continuous central ignition is no longer possible due to the long projectile. Moreover, the required mechanical strength of the charge casing cover and charge casing bottom counteracts a relatively simple ignition transfer from the primary charge to the projectile charge. This is where the present invention comes to the aid in that the annular transfer charge disposed underneath the charge casing cover of the primary charge relatively quickly destroys the ignition transfer inhibiting charge casing cover of the primary charge and the bottom of the projectile charge. The transfer charge disposed at the bottom of the projectile charge causes the propelling charge disposed within the projectile charge to be ignited without a noticeable time delay and thus a more favorable combustion behavior is ensured.

BRIEF DESCRIPTION OF THE DRAWINGS

The invention will be described and explained below in greater detail with reference to the sole drawing Figure which is a longitudinal sectional overall view of an ammunition round according to the invention.

DETAILED DESCRIPTION OF THE INVENTION

In the Figure, the reference numeral 10 identifies a large-caliber ammunition round composed of a primary charge 20 and a projectile charge 30. The ammunition round 10, when loaded, is disposed in a gun barrel 50 (not shown in detail). The rear primary charge 20 includes a generally cylindrical propelling charge casing member 21 provided with a casing bottom 22, for example a metal casing stub, having an axially extending propelling charge igniter 2 fastened thereto. The interior of the charge casing is filled with loose propelling charge powder 26 but can be filled also completely with tubular propellant. At its front end, i.e., the end facing away from the casing bottom 22, the propelling charge casing member 21 is closed by a charge casing cover 28 including a thin charge covering disc 28' disposed in the center of the cover. Underneath this charge casing cover 28, and adjacent its circumference, there is disposed an annular transfer charge 29.

The projectile charge 30 has a charge casing in which a subcaliber kinetic energy projectile 40 and its sabot 42 are fastened. The charge casing includes a generally cylindrical propelling charge casing member 31 provided at its front end with a cover 33 with a central opening through which the rear end of the projectile 40 extends into the charge casing. A projectile guide mechanism 44, not identified in detail, is fastened at the tail of the kinetic energy projectile 40 and extends to a propelling charge casing bottom 38 which delimits and closes the rear end of the propelling charge casing member 31 of projectile charge 30.

In its frontal or forward region, the propellant of projectile charge 30 is composed of loosely piled propelling charge powder 36. Adjacent the rear region of kinetic energy projectile 40, i.e., at the level of the guide mechanism 44, projectile charge 30 is provided with a propelling charge in the form of a tubular propellant 32, which is followed by an annular transfer charge 39 disposed against the bottom 38 adjacent its circumference.

Instead of a propelling charge in projectile charge 30 in the form of a tubular propellant 32 and loosely piled propelling charge powder 36 as shown in the Figure, the propelling charge in projectile charge 30 may also be composed entirely of tubular propellant 32.

The propelling charge casing member 21 of the primary charge 20 and the propelling charge casing member 31 of projectile charge 30 are composed of combustible material.

The bottom 38 of projectile charge 30 and the charge casing cover 28 with its charge covering disc 28' of primary charge 20 are also manufactured of combustible material. In order to prevent damage to the ammunition 10 during loading, charge casing cover 28, in particular, and bottom 38 of projectile charge 30 must have a high mechanical strength and thus would tend normally to inhibit a relatively simple ignition transfer from primary charge 20 to projectile charge 30.

Because of the provision of the thin charge covering disc 28', the ignition transfer in ammunition round 10 is more easily possible in its center than near its circumference. Thus the tubular propellant 32 disposed centrally in projectile charge 30 would tend to be ignited earlier than the tubular propellant 32 and the propelling charge powder 36 disposed in the vicinity of the circumference.

Due to the arrangement according to the present invention of an annular transfer charge 29 in the outer circumferential region of primary charge 20 underneath its charge casing cover 28 and an annular transfer charge 39 in the outer circumferential region of projectile charge 30 above bottom 38, such unfavorable combustion behavior is prevented since the annular transfer charge 29 relatively quickly mechanically destroys the ignition transfer inhibiting charge casing cover 28 and the casing bottom 38 of projectile charge 30.

As an advantageous feature of the invention, transfer charge 29 of primary charge 20 therefore includes an ignition powder, for example, nitrocellulose black powder, which produces a combustion rich in gas.

The annular transfer charge 39 likewise disposed in the outer circumferential region of projectile charge 30 is composed of black powder that has a combustion characteristic low in gas and rich in particles. This black powder ignites the tubular charge 32 disposed in projectile charge 30 and propelling charge powder 36 without any noticeable delay in time compared to the primary charge 20. The combination of the two transfer charges 29, 39 and their geometrical arrangement in the circumferential region of charges 20 and 30 thus enhances the combustion behavior of a two-part large-caliber ammunition round 10 to a considerable degree.

The invention now being fully described, it will be apparent to one of ordinary skill in the art that any changes and modifications can be made thereto without departing from the spirit or scope of the invention as set forth herein.

What is claimed:

1. An ammunition round comprising a projectile, two separate charges to be aligned one behind the other including a forward projectile charge, with a rear end of said projectile extending far into said forward charge, and a rear primary charge, and first and second annular transfer charges disposed respectively adjacent a front end of said primary charge and a rear end of said projectile charge in the region of a respective outer circumference of said projectile charge and of said primary charge, and wherein:

said forward projectile charge includes a charge casing containing a propellant charge and including a generally cylindrical member which is closed at its rear end by a bottom member and which has a cover with a central opening, through which the projectile extends into the charge casing, at its front end; said rear primary charge includes a charge casing containing a propellant charge and including a generally cylindrical member which is closed at its rear end by a bottom member and its front end by a cover; and said charge casing of said forward projectile charge and at least said cylindrical member and said cover of said charge casing of said rear primary charge are formed of a combustible material.

2. An ammunition round as defined in claim 1 wherein said first annular transfer charge is disposed within said charge casing of said primary charge adjacent said cover.

3. An ammunition round as defined in claim 2 wherein said first annular transfer charge is composed of an ignition powder which is rich in gas after ignition.

4. An ammunition round as defined in claim 3 wherein said ignition powder is nitrocellulose black powder.

5. An ammunition round as defined in claim 2 wherein said second annular transfer charge is disposed within said charge casing of said projectile charge adjacent said bottom member.

6. An ammunition round as defined in claim 5 wherein: the propellant charge in said charge casing of said projectile charge is composed at least in part of a tubular propellant, and said tubular propellant is disposed at least in a rear portion of said charge casing of said projectile charge and immediately adjacent said second annular transfer charge.

7. An ammunition round as defined in claim 6 wherein said propellant charge in said charge casing of said forward projectile charge includes loosely piled propelling charge powder disposed in front of said tubular propellant.

8. An ammunition round as defined in claim 6 wherein said second annular transfer charge is composed of black powder.

9. An ammunition round as defined in claim 8 wherein said first annular transfer charge is composed of an ignition powder.

10. An ammunition round comprising: a projectile; two separate charges to be aligned one behind the other including a forward projectile charge, with a rear end of said projectile extending far into said forward projectile charge, and a rear primary charge, said primary charge including a charge casing containing a propellant charge and including a generally cylindrical member which is closed at its rear end by a bottom member and at its front end by a cover, with at least said cylindrical member and said cover being formed of a combustible material; and first and second annular transfer charges disposed respectively adjacent a front end of said primary charge and a rear end of said projectile charge in the region of a respective outer circumference of said projectile charge and of said primary charge, with said first annular transfer charge being disposed immediately underneath said cover.

11. An ammunition round as defined in claim 10 wherein said first annular transfer charge is composed of an ignition powder.

12. An ammunition round comprising a projectile, two separate charges to be aligned one behind the other including a forward projectile charge, with a rear end of said projectile extending far into said forward charge, and a rear primary charge, and first and second annular transfer charges disposed respectively adjacent a front end of said primary charge and a rear end of said projectile charge in the region of a respective outer circumference of said projectile charge and of said primary charge, and wherein: said forward projectile charge includes a charge casing containing a propellant charge and including a generally cylindrical member which is closed at its rear end by a bottom member and which has a cover with a central opening, through which said projectile extends into said charge casing, at its front end; said charge casing is formed of a combustible material; said second annular transfer charge is disposed within said charge casing immediately adjacent said bottom member; and said propellant charge, at least immediately adjacent said second annular transfer charge, is composed of a tubular propellant.

13. An ammunition round as defined in claim 12 wherein said charge propellant further includes loosely piled propellant charge powder disposed in front of said tubular propellant.

14. An ammunition round as defined in claim 12 wherein said second annular transfer charge is composed of black powder.

* * * * *